US012070700B2

(12) United States Patent
Iovino et al.

(10) Patent No.: US 12,070,700 B2
(45) Date of Patent: Aug. 27, 2024

(54) HORSE PUPPET AUDIO PLAYER DEVICE

(71) Applicants: Jessica Iovino, Staten Island, NY (US); Robert Iovino, Staten Island, NY (US)

(72) Inventors: Jessica Iovino, Staten Island, NY (US); Robert Iovino, Staten Island, NY (US)

( * ) Notice: Subject to any disclaimer, the term of this patent is extended or adjusted under 35 U.S.C. 154(b) by 182 days.

(21) Appl. No.: 17/831,980

(22) Filed: Jun. 3, 2022

(65) Prior Publication Data

US 2023/0390657 A1 Dec. 7, 2023

(51) Int. Cl.

| | |
|---|---|
| ***A63H 3/14*** | (2006.01) |
| ***A63H 3/02*** | (2006.01) |
| ***A63H 3/28*** | (2006.01) |
| ***A63H 3/52*** | (2022.01) |

(52) U.S. Cl.

CPC ..... *A63H 3/14* (2013.01); *A63H 3/02* (2013.01); *A63H 3/28* (2013.01); *A63H 3/52* (2013.01)

(58) Field of Classification Search

CPC ..... A63H 3/14; A63H 3/28

See application file for complete search history.

(56) References Cited

U.S. PATENT DOCUMENTS

| | | | | | |
|---|---|---|---|---|---|
| 3,737,196 | A * | 6/1973 | Bodor | A63H 3/36 | 297/181 |
| 3,942,283 | A * | 3/1976 | Rushton | A63H 3/14 | 446/369 |
| 4,854,908 | A | 8/1989 | Shively | | |
| 4,869,701 | A | 9/1989 | Kawai | | |
| 4,871,341 | A * | 10/1989 | Sommers | A63H 3/14 | 446/329 |
| 4,944,710 | A * | 7/1990 | Sommers | A63H 3/14 | 446/329 |
| 5,080,626 | A * | 1/1992 | Maddi | A63H 3/14 | 446/329 |
| 5,791,965 | A * | 8/1998 | Kim | A63H 3/006 | 446/485 |
| 5,975,980 | A * | 11/1999 | Whiteneck | A63H 3/14 | 446/329 |
| 6,780,076 | B2 | 8/2004 | Horchler | | |
| 7,857,678 | B2 * | 12/2010 | Isenberg | A63H 3/02 | 446/268 |
| D636,034 | S | 4/2011 | Oestreicher | | |
| 9,186,592 | B2 | 11/2015 | Zwiers | | |
| D842,394 | S | 3/2019 | Rogers | | |
| 2003/0126776 | A1 * | 7/2003 | Lewis | G06Q 10/06 | 445/24 |

(Continued)

FOREIGN PATENT DOCUMENTS

| | | |
|---|---|---|
| WO | WO2012024264 | 2/2012 |

*Primary Examiner* — John A Ricci

(57) ABSTRACT

A horse puppet audio player device for celebrating a baseball home run includes a puppet configured for resembling a horse. The horse has a body. A head of the horse is positioned on a top surface of the body. An opening for a pocket is positioned on a bottom surface of the body. A plurality of legs is positioned on the bottom surface of the body and protrudes out therefrom. A plurality of hair is positioned on the horse and includes a tail and a head hair. The tail is positioned on an end of the body of the horse. The head hair is positioned on a path from the head to the body of the horse. A jersey is worn on the body of the horse. An audio player is positioned in a leg of the plurality of legs.

13 Claims, 5 Drawing Sheets

(56) References Cited

U.S. PATENT DOCUMENTS

| | | | | |
|---|---|---|---|---|
| 2009/0181597 | A1* | 7/2009 | Maddi | A63H 3/46 446/329 |
| 2010/0136877 | A1* | 6/2010 | Maddi | A63H 3/46 446/390 |
| 2016/0158112 | A1 | 6/2016 | Summers | |
| 2021/0086091 | A1 | 3/2021 | Jackson | |

* cited by examiner

HORSE PUPPET AUDIO PLAYER DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to toy horse device and more particularly pertains to a new toy horse device for celebrating a baseball home run.

(2) Description of Related Art Including Information Disclosed Under 37 CFR 1.97 and 1.98

The prior art relates to toy horse devices. Know prior art includes a variety of toy horse devices having an audio player or speaker. Known prior art lacks a toy horse device having an audio player and a puppet sleeve being configured for celebrating a home run in a baseball game.

BRIEF SUMMARY OF THE INVENTION

An embodiment of the disclosure meets the needs presented above by generally comprising a puppet configured for resembling a horse. The horse has a body, and a head of the horse is positioned on a top surface of the body. An opening for a pocket is positioned on a bottom surface of the body. A plurality of legs is positioned on the bottom surface of the body and protrudes out therefrom. A plurality of hair is positioned on the horse and includes a tail and a head hair. The tail is positioned on an end of the body of the horse. The head hair is positioned on a path from the head to the body of the horse. A jersey is worn on the body of the horse. An audio player is positioned in a leg of the plurality of legs.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
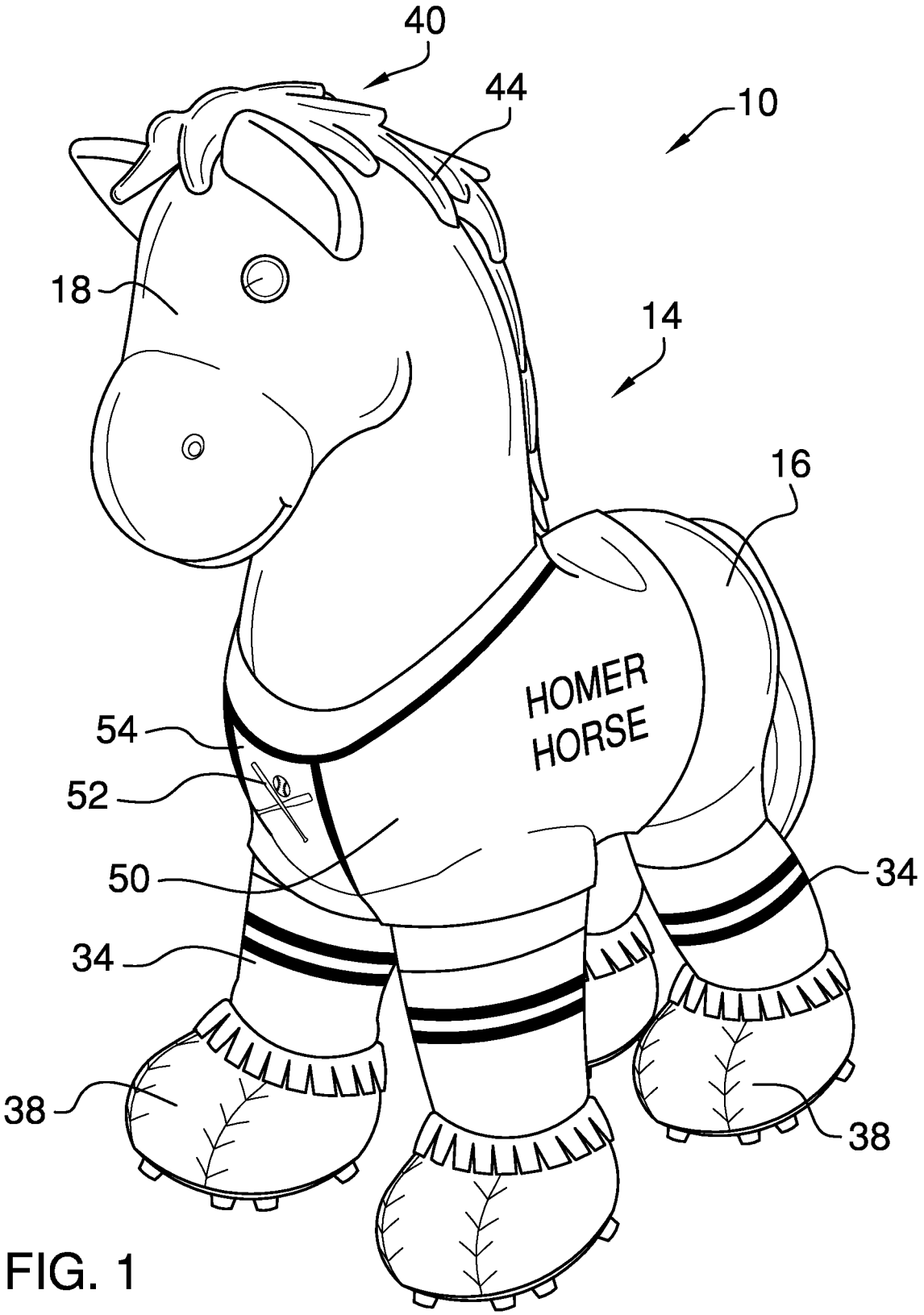
FIG. 1 is an isometric view of a horse puppet audio player device according to an embodiment of the disclosure.
Figure 2:
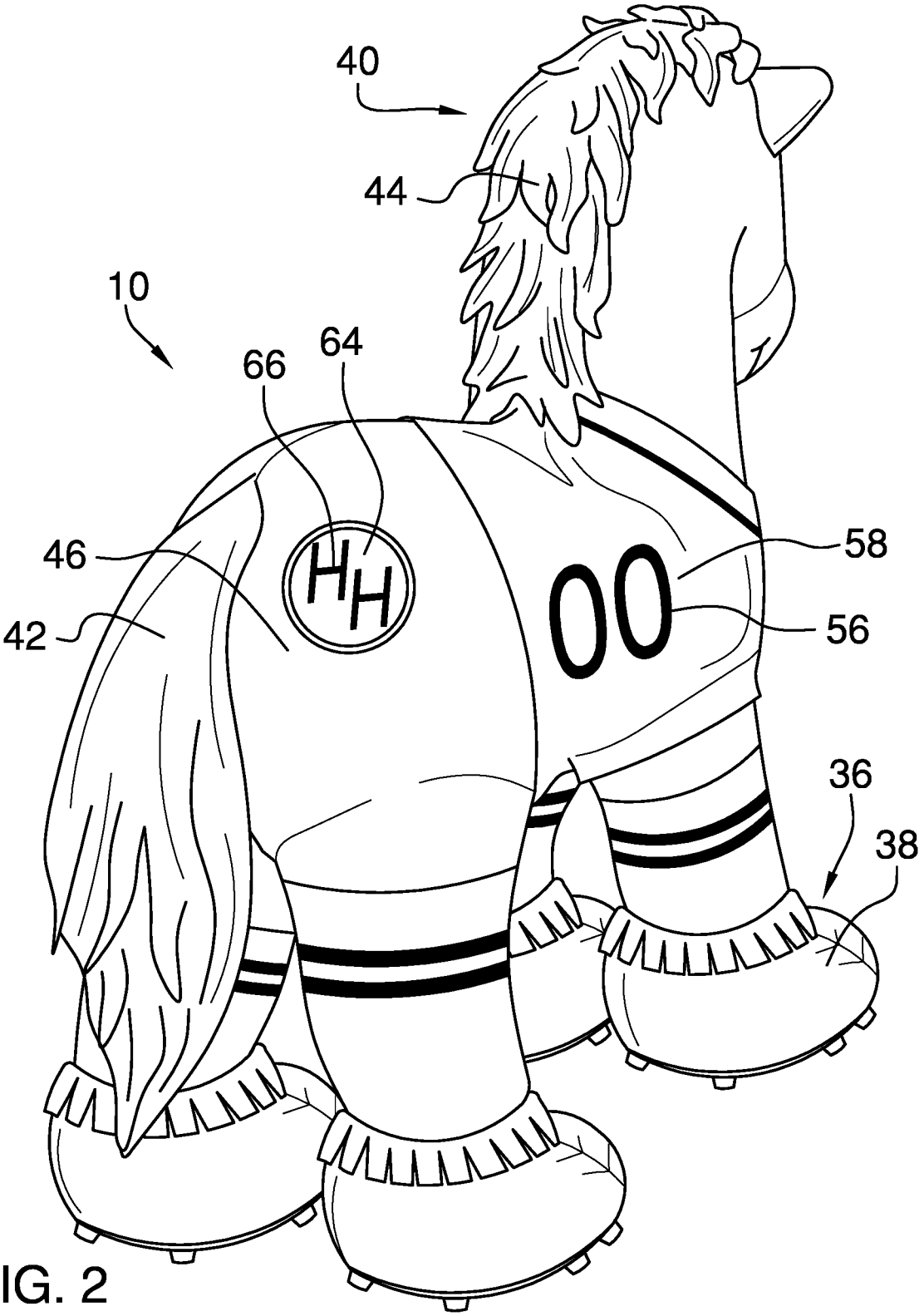
FIG. 2 is a back isometric view of an embodiment of the disclosure.
Figure 3:
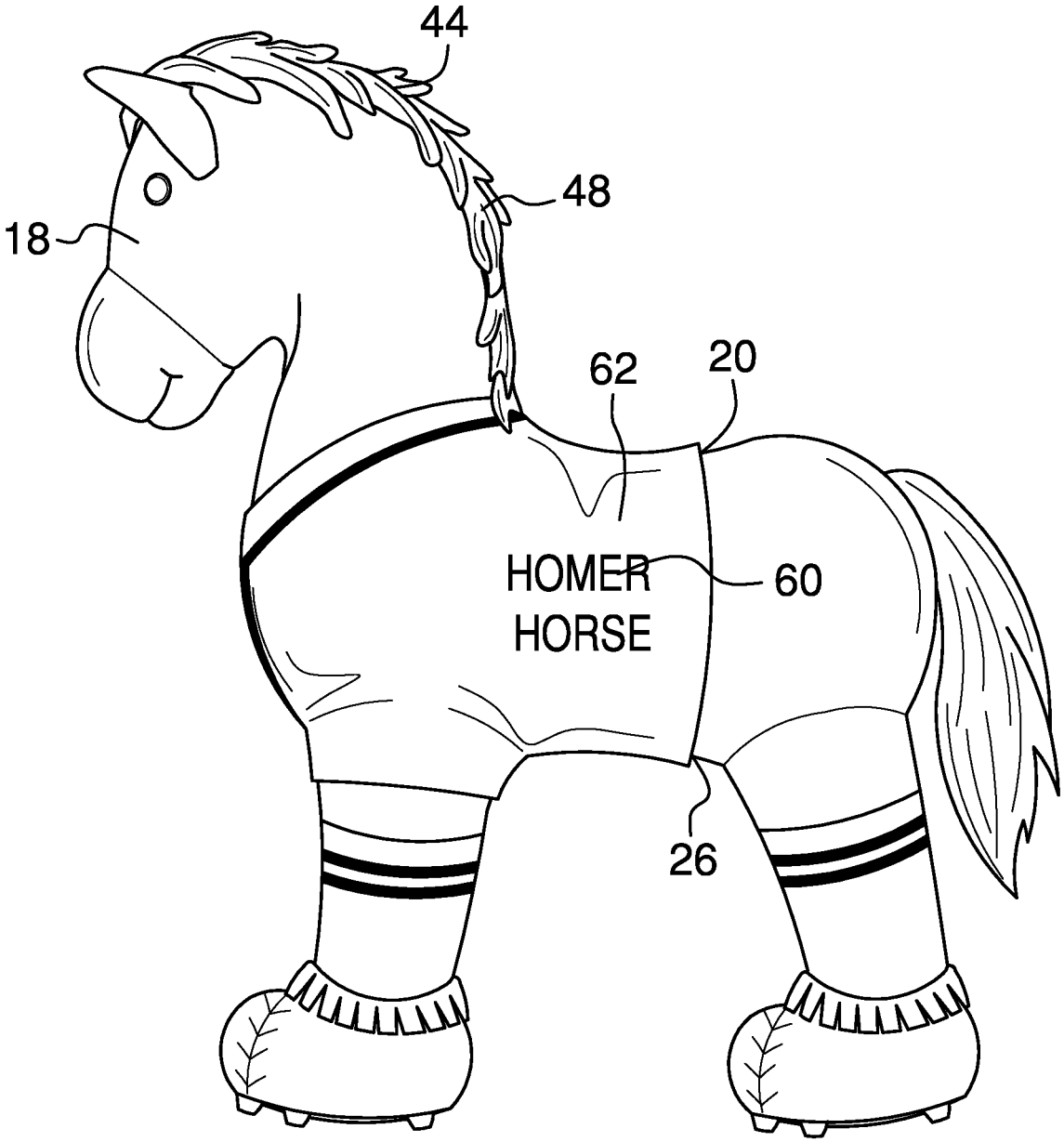
FIG. 3 is a side view of an embodiment of the disclosure.
Figure 4:
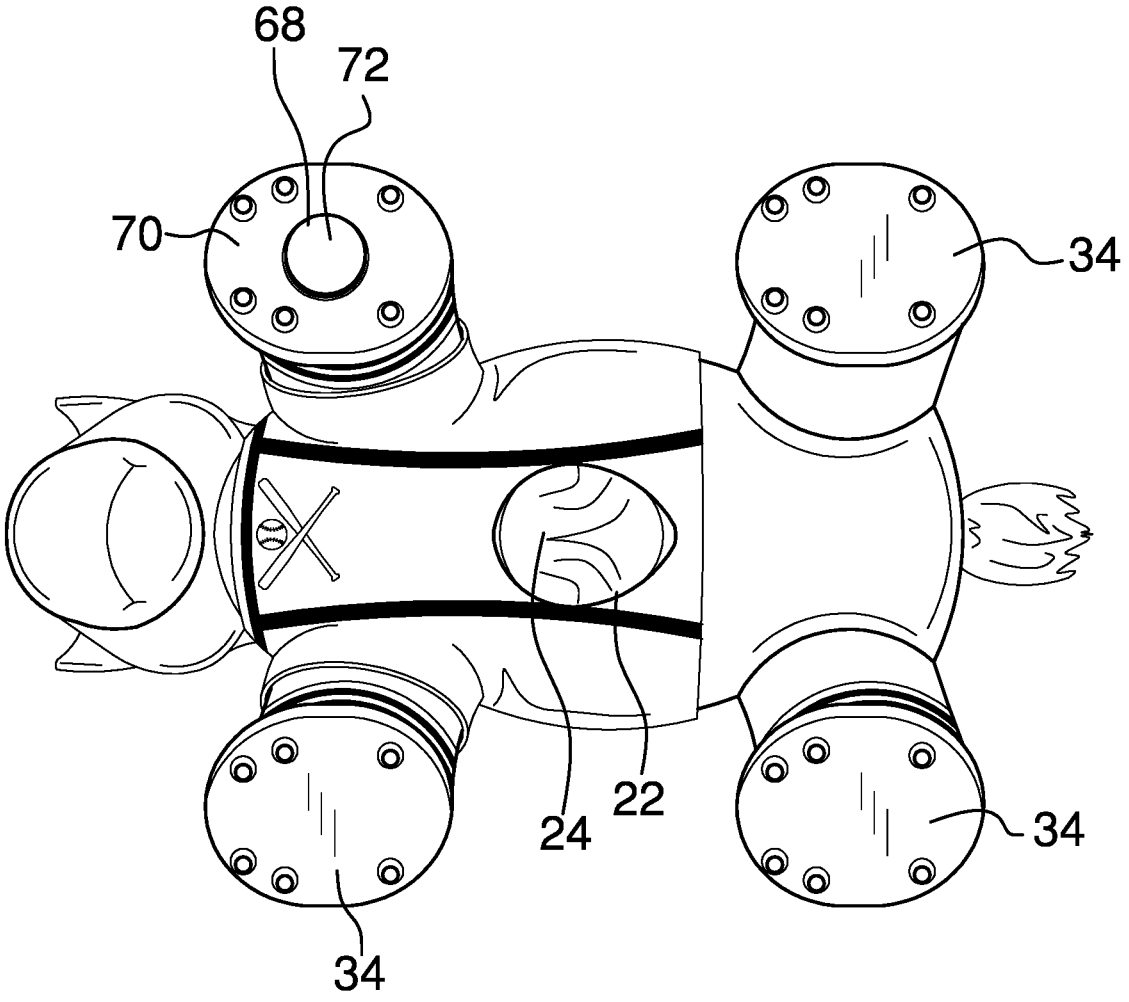
FIG. 4 is a bottom view of an embodiment of the disclosure.
Figure 5:
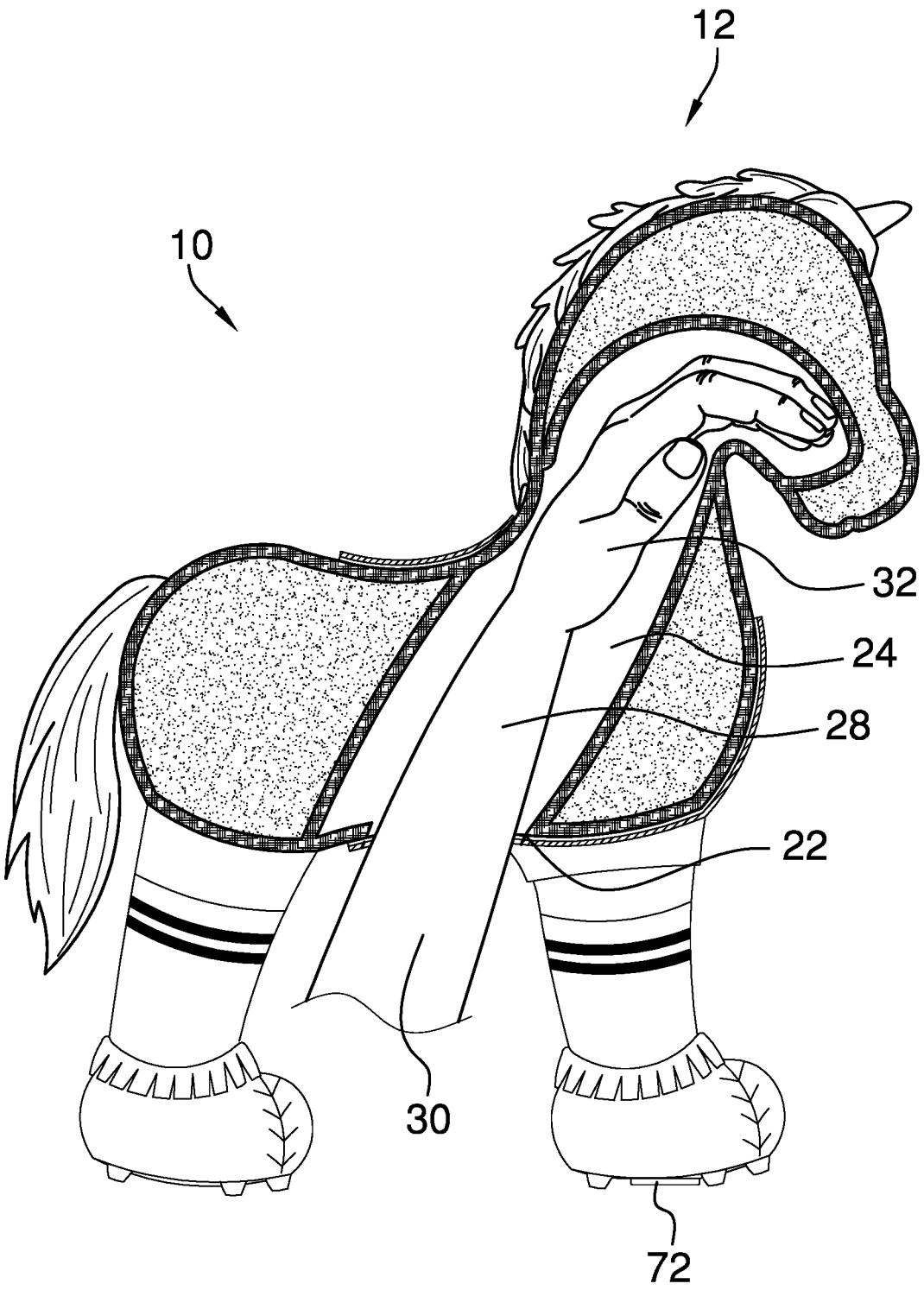
FIG. 5 is a cross-sectional view of an in-use embodiment of the disclosure.

With reference now to the drawings, and in particular to FIGS. 1 through 5 thereof, a new toy horse device embodying the principles and concepts of an embodiment of the disclosure and generally designated by the reference numeral 10 will be described.

As best illustrated in FIGS. 1 through 5, the horse puppet audio player device 10 generally comprises a puppet 12. The puppet 12 is configured for resembling a horse 14. The puppet 12 has a plush material being configured for being soft and flexible. The horse 14 has a body 16. A head 18 is positioned on a top surface 20 of the body 16. An opening 22 for a pocket 24 is positioned on a bottom surface 26 of the body 16. The pocket 24 is a conduit from the bottom surface 26 of the body 16 to the head 18 of the horse 14. The pocket 24 is configured for holding an arm 28 of a user 30, thus the hand 32 of the user 30 being positioned proximate to the head 18 of the horse 14. The pocket 24 allows the user 30 to create motion of the head 18 of the horse 14 to mimic horse mannerisms.

A plurality of legs 34 is positioned on the bottom surface 26 of the body 16 and protrudes out therefrom. Each of the legs 34 has a hoof 36. The hoof 36 is a foot of a horse 14. A cleat 38 is worn on the hoof 36 of each of the legs 34. The cleat 38 is a shoe configured for being worn playing baseball. A plurality of hair 40 is positioned on the horse 14. The plurality of hair 40 is configured for being colorable, thus the plurality of hair 40 can be a variety of colors. The plurality of hair 40 includes a tail 42 and a head hair 44. The tail 42 is positioned on an end 46 of the body 16 of the horse 14 and is configured for being the back of the horse 14. The head hair 44 is positioned on a path 48 from the head 18 to the body 16 of the horse 14.

A jersey 50 is worn on the body 16 of the horse 14. The jersey 50 is configured for being a baseball jersey. A baseball image 52 is positioned on a front 54 of the jersey 50. The baseball image 52 is configured for being a baseball and a pair of baseball bats. A pair of numeral numbers 56 is positioned on a first side 58 of the jersey 50. The pair of numeral numbers 56 is a pair of zeros. On the contrary, a logo 60 is positioned on a second side 62 of the jersey 50. The logo 60 is configured to spell out the words Homer Horse. Additionally, an emblem 64 is positioned proximate to the tail 42 of the horse 14. The emblem 64 is a pair of alphabetical letters 66, where the pair of alphabetical letters 66 is a pair of H's. The emblem 64 is complementary to the logo 60 of the jersey 50.

An audio player 68 is positioned in a leg 70 of the plurality of legs 34. The audio player 68 has a button 72 being positioned on a surface 74 of the hoof of the leg 70. The button 72 is an actuator for playing an audio. The audio is configured for a voice to exclaim, "Home Run!" The button 72 is configured for being pressed when a baseball team scores a home run in their game.

In use, the user 30 inserts their arm 28 into the pocket 24 of the puppet 12. The hand 32 of the user 30 can move the head 18 of the horse 14 to mimic horse mannerisms. The puppet 12 is configured to be worn when watching a baseball game. When a baseball teams scores a home run, the user 30 can press the button 72 of the audio player 68 for the puppet 12 to exclaim, "Home Run!"

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A horse puppet device configured for extolling a home run in a baseball game, the device comprising:

a puppet configured for resembling a horse, the horse having a body, a head of the horse being positioned on a top surface of said body, an opening for a pocket being positioned on a bottom surface of the body, the pocket being a conduit from the bottom surface of the body to the head of the horse, the pocket being a single continuous channel having a first section extending upwardly and forwardly from the bottom surface and a second section curving forwardly and then downwardly extending away from the first section wherein the pocket is configured for holding an arm of the user such that a palm of the user is positioned within the first section and fingers of the user are positioned to extend into the second section wherein the hand of the user is positioned proximate to the head of the horse allowing the user to move an entirety of the head of the horse;

a plurality of legs being positioned on the bottom surface of the body and protruding out therefrom;

a plurality of hair being positioned on the horse, the plurality of hair including:

a tail being positioned on an end of the body of the horse; and a head hair being positioned on a path from the head to the body of the horse, a jersey being worn on the body of the horse;

an audio player being positioned in a leg of the plurality of legs.

2. The horse puppet device of claim 1, further comprising the puppet having a plush material, the plush material being configured for being soft and flexible.

3. The horse puppet device of claim 1, further comprising each of the legs having a hoof, the hoof being a foot of a horse.

4. The horse puppet device of claim 3, further comprising a cleat being worn on the hoof of each of the legs, the cleat being a shoe configured for being worn playing baseball.

5. The horse puppet device of claim 1, further comprising the plurality of hair being configured for being colorable.

6. The horse puppet device of claim 1, further comprising the tail being configured for being the back of the horse.

7. The horse puppet device of claim 6, further comprising an emblem being positioned proximate to the tail of the horse, the emblem being a pair of alphabetical letters, the pair of alphabetical letters being a pair of H's.

8. The horse puppet device of claim 1, further comprising the jersey being configured for being a baseball jersey.

9. The horse puppet device of claim 8, further comprising a baseball image being positioned on a front of the jersey, a pair of numeral numbers being positioned on a first side of the jersey.

10. The horse puppet device of claim 9, further comprising the pair of numeral numbers being a pair of zeros.

11. The horse puppet device of claim 10, further comprising a logo being positioned on a second side of the jersey.

12. The horse puppet device of claim 1, further comprising the audio play having a button, the button being positioned on a surface of the hoof of the leg, the button being an actuator for playing an audio.

13. A horse puppet device configured for extolling a home run in a baseball game, the device comprising:

a puppet configured for resembling a horse, the puppet having a plush material, the plush material being configured for being soft and flexible, the horse having a body, a head of the horse being positioned on a top surface of said body, an opening for a pocket being positioned on a bottom surface of the body, the pocket being a conduit from the bottom surface of the body to the head of the horse, the pocket being a single continuous channel having a first section extending upwardly and forwardly from the bottom surface and a second section curving forwardly and then downwardly extending away from the first section wherein the pocket is configured for holding an arm of the user such that a palm of the user is positioned within the first section and fingers of the user are positioned to extend into the second section wherein the hand of the user is positioned proximate to the head of the horse allowing the user to move an entirety of the head of the horse;

a plurality of legs being positioned on the bottom surface of the body and protruding out therefrom, each of the legs having a hoof, the hoof being a foot of a horse, a cleat being worn on the hoof of each of the legs, the cleat being a shoe configured for being worn playing baseball;

a plurality of hair being positioned on the horse, the plurality of hair being configured for being colorable, the plurality of hair including:

a tail being positioned on an end of the body of the horse, the tail being configured for being the back of the horse; and a head hair being positioned on a path from the head to the body of the horse;

a jersey being worn on the body of the horse, the jersey being configured for being a baseball jersey, a baseball image being positioned on a front of the jersey, a pair of numeral numbers being positioned on a first side of the jersey, the pair of numeral numbers being a pair of zeros, a logo being positioned on a second side of the jersey;

an emblem being positioned proximate to the tail of the horse, the emblem being a pair of alphabetical letters, the pair of alphabetical letters being a pair of H's; and an audio player being positioned in a leg of the plurality of legs, the audio play having a button, the button being positioned on a surface of the hoof of the leg, the button being an actuator for playing an audio.

* * * * *